US006523279B2

(12) United States Patent
Kugler

(10) Patent No.: US 6,523,279 B2
(45) Date of Patent: Feb. 25, 2003

(54) DRYING ROLL FOR DRYING A MATERIAL WEB

(75) Inventor: Georg Kugler, Heidenheim (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/949,826

(22) Filed: Sep. 12, 2001

(65) Prior Publication Data

US 2002/0092197 A1 Jul. 18, 2002

(30) Foreign Application Priority Data

Sep. 25, 2000 (DE) ..... 100 47 369

(51) Int. Cl.[7] ..... F26B 3/00

(52) U.S. Cl. ..... 34/455; 34/452; 34/122; 34/128; 34/636; 34/110

(58) Field of Search ..... 34/448, 452, 453, 34/454, 455, 456, 114, 115, 122, 128, 629, 635, 636, 109, 110

(56) References Cited

U.S. PATENT DOCUMENTS 3,098,371 A * 7/1963 Fleissner ..... 68/5 R
3,447,247 A * 6/1969 Daane ..... 34/122
3,541,697 A * 11/1970 Villalobos ..... 34/115
4,364,185 A * 12/1982 Dussourd et al. ..... 34/122
4,835,880 A * 6/1989 Vecchia ..... 34/115
5,020,242 A * 6/1991 Mayer et al. ..... 34/115

FOREIGN PATENT DOCUMENTS

| | | |
|---|---|---|
| DE | 640033 | 12/1936 |
| WO | 98/10141 | 3/1998 |

* cited by examiner

*Primary Examiner*—Ira S. Lazarus
*Assistant Examiner*—Kathryn S. O'Malley
(74) *Attorney, Agent, or Firm*—Greenblum & Bernstein, P.L.C.

(57) ABSTRACT

Roll and drying section of a machine for producing a material web and process for drying a material web. The roll includes a jacket having a plurality of throughput openings, a device for supplying gas through the jacket, and a second jacket located within the jacket being arranged to form a ring chamber with the jacket. The second jacket is gas tight to seal the ring chamber in a gas-tight manner from an interior of the second jacket.

45 Claims, 3 Drawing Sheets

DRYING ROLL FOR DRYING A MATERIAL WEB

CROSS-REFERENCE TO RELATED APPLICATIONS

The present application claims priority under 35 U.S.C. §119 of German Patent Application No. 100 47 369.5, filed on Sep. 25, 2000, the disclosure of which is expressly incorporated by reference herein in its entirety.

BACKGROUND OF THE INVENTION

1. Field of the Invention

The present invention relates to a roll to be used in the drying section of a machine for producing a material web, e.g., for guiding and holding a paper web being impacted by a drying gas. The roll has a jacket, which, when in operation, the material web is guided over to partially wrap the roll. The roll also includes gas penetration openings and a device for supplying gas through the roll jacket.

2. Discussion of Background Information

Such rolls are used, e.g., as suction guiding rolls in drying sections in which the material web is dried by jet impingement drying, i.e., blowing the material web with drying air. When the suction guidance roll is provided with suction, the material web is held against the roll and can be guided by the roll in the desired manner.

For this purpose, the interior of the suction guidance roll is embodied in a hollow manner and is normally connected to a suction device by way of the roll bearings. This requires relatively large bearing pins and corresponding bearing support for the suction guidance roll.

Therefore, it is also known to provide the interior of the suction guidance roll with suction by a suction box located outside the roll. However, in this regard, the entire inner chamber of the suction guidance roll is provided with suction. Therefore, the suctioned volume depends on the diameter of the roll and is generally relatively large. This has especially negative effects in the start-up phase because a relatively long time elapses before a desired underpressure is achieved in the roll.

SUMMARY OF THE INVENTION

The present invention provides a roll of the type mentioned at the outset that does not exhibit the above-noted disadvantages. In particular, the start-up phase should be shortened. Moreover, the flow rate of the gas should be optimized and a simple construction of the roll should be attained.

Accordingly, the present invention includes a second, gas-tight jacket in the interior of the roll jacket that forms a ring chamber together with the outer roll jacket. The ring chamber is sealed off from the interior of the inner jacket in a gas-tight manner.

By providing a second, gas-tight jacket in the interior of the roll jacket and, due to the ring chamber formed thereby, which is sealed off from the interior of the inner jacket, the suctioned volume of the roll can be considerably reduced as compared to known rolls. For example, the suctioned space can now include only approximately 10 to approximately 15% of the total volume. A desired underpressure can thus be built up in a shorter time than in the case of known rolls. Moreover, the flow rate of the suctioned air over the size of the intermediate chamber can be brought to a desired amount. In particular, this results in short reaction times upon the introduction of a material web, for example, after the interruption of production due to a web tear or the like.

A further advantage lies in the fact that the roll can thus have a relatively simple construction because the main portion of the roll has only a carrying and support function.

In particular, the roll according to the invention is used as a suction guiding roll for guiding and holding a material web in a drying section in which the material web is dried by jet impingement drying. However, the roll according to the invention can also be used for flow-through drying of a material web, in which a drying gas, e.g., air, is fed through the material web.

It is possible to feed the drying gas through the material web into the intermediate chamber of the roll according to the invention, in particular from outside. Furthermore, the roll is preferably embodied as a suction roll in that a suction device is attached to it. However, instead of this, it is also possible to provide a blowing zone in the region of the wrapping of the outer roll jacket by the material web, e.g., to arrange a blow box there. In this manner, it is also possible to feed a drying gas from the outside through the material web into the intermediate chamber. It is furthermore possible to combine such a blowing zone with a suction device connected to the intermediate-chamber.

If a suction device is used, it is preferably attached to the intermediate chamber on the face end. This simplifies the construction of the roll and prevents a large diameter of the bearings. In this manner, it can be particularly preferred for a suction box to be provided that is aligned with the intermediate chamber. Connective lines between the suction device and the intermediate chamber may therefore be omitted.

In principle, however, the roll according to the invention can also be constructed for the purpose of feeding the drying gas from the intermediate chamber, through the material web, and outwards. In this case, the material web is pressed against the roll by a drying wire.

Preferably, the roll in this case can also be embodied or formed as a blowing roll in that a blowing device is attached to the intermediate chamber. In this case as well, the blowing device is preferably attached to the intermediate chamber on the face side in order to achieve a simple construction of the roll.

It is also particularly preferred for a blow box to be provided that is aligned with the intermediate chamber. This in turn makes it possible for connective lines between the blow box and the intermediate chamber to be omitted.

Instead of a blowing device connected to the intermediate chamber, a suction zone can be provided in the wrapping region of the roll jacket. For example, a suction box can be arranged there. In this manner, it is also possible for drying gas to be supplied from the intermediate chamber, through the material web, and outwards. Such a suction zone can also be combined with a blowing device attached to the intermediate chamber.

In order to prevent waste flows, the blow box and suction box are each sealed off from the outside, e.g., by sealing brushes or doctors. Moreover, covers fixed in the intermediate chamber for the throughput openings of the outer roll jacket can preferably be provided for the region of the roll not wrapped by the material web. This also prevents waste flow and improves the effectiveness of the device.

In order to support the two roll jackets, it is preferable for a central carrier to be provided that extends along the longitudinal axis of the roll, upon which the two roll jackets are supported such that they may be rotated around their longitudinal axes. A particularly advantageous construction results when spoke-like support elements are arranged in the interior of the inner jacket, by way of which the inner jacket is supported on the carrier. Moreover, it is also preferable for the outer jacket to be carried by the internal jacket.

Finally, the size of the intermediate chamber can preferably be selected to correspond to a desired flow rate of the gas. In particular, a greater flow rate and faster reaction time can be achieved by decreasing the size of the inner chamber.

The present invention is directed to a roll for a drying section of a machine for producing a material web. The roll includes a jacket having a plurality of throughput openings, a device for supplying gas through the jacket, and a second jacket located within the jacket being arranged to form a ring chamber with the jacket. The second jacket is gas tight to seal the ring chamber in a gas-tight manner from an interior of the second jacket.

In accordance with a feature of the instant invention, during operation, the material web may at least partially wrap the jacket.

According to another feature of the present invention, the roll can be structured and arranged for guiding and holding the paper web while being impinged by a drying gas, The material web is guided over at least a portion of the jacket and a gas may be supplied by the gas supply device from outside through the material web into the ring chamber.

According to another feature, a gas can be supplied from outside of the jacket into the ring chamber.

Further, a suction device can be coupled to the ring chamber. The suction device may be coupled to the ring chamber on a face end. The suction device can include a suction box aligned with the ring chamber.

The material web may be guided to at least partially wrap around the jacket and a blowing zone can be arranged in a region in which the material web wraps the jacket. The blowing zone may be formed by a blow box. Further, the blow box can be sealed against waste flows with lateral seals. The lateral seal may include at least one of sealing brushes and doctors.

The material web can be guided over at least a portion of the jacket and a gas may be supplied by the gas supply device outwardly from the ring chamber through the material web.

In accordance with still another feature of the invention, a gas can be supplied outwardly from the ring chamber.

According to a further feature of the present invention, a blowing device may be coupled to the ring chamber.

A blowing device can be coupled to an end face of the ring chamber. Further, the blowing device may include a blow box aligned with the ring chamber.

Moreover, the material web can be guided to at least partially wrap the jacket, a gas can be supplied outwardly from the ring chamber through the material web, and a suction zone may be arranged in a region in which the material web wraps the jacket. The suction zone can be formed by a suction box. Further, the suction box may be sealed against waste flows with lateral seals. The lateral seal can include at least one of sealing brushes and doctors.

In accordance with a further feature of the instant invention, fixed coverings for the throughput openings may be located in the inner chamber. The material web can be guided to at least partially wrap the jacket, and the fixed coverings may be arranged in a region of the jacket which is not wrapped by the material web.

According to a still further feature of the invention, a central carrier can be arranged to extend along a longitudinal axis of the roll. The roll jacket and the second jacket may be rotatably supported on the central carrier. Spoke-like support elements may be arranged in an interior of the second jacket, and the spoke-like support elements can be structured and arranged to support the second jacket on the central carrier.

In accordance with another feature of the present invention, the jacket can be carried by the second jacket.

According to still another feature, a size of the ring chamber can correspond to a desired gas flow speed.

The ring chamber size can be between approximately 10 to approximately 15% of a volume of an entire interior of the jacket.

The present invention is directed to a dryer section in a machine for producing a material web. The dryer section includes a roll having an outer jacket with a plurality of throughput openings structured and arranged for gas flow and an inner jacket located within the jacket being arranged to form a ring chamber with the outer jacket, in which the inner jacket is gas tight to seal the ring chamber in a gas-tight manner from an interior of the inner jacket. A wire is arranged to at least partially wrap the outer jacket, such that the wire is structured and arranged to guide the material to at least partially wrap the outer jacket.

According to a feature of the invention, a blowing device can be arranged outside of the outer jacket in a region in which the material web wraps the outer jacket. Gas can be supplied through the material web and into the ring chamber. A suction device may be coupled to the ring chamber. The blowing device can include at least one blowing hood arranged to impinge the material web with hot air. Further, the suction device can be coupled to a face end of the ring chamber.

In accordance with another feature of the instant invention, a blowing device can be arranged to blow gas outwardly from the ring chamber and through the material web. A suction device may be arranged in a region in which the material web wraps the outer jacket. The blowing device is coupled to the ring chamber. Further, the blowing device may be coupled to a face end of the ring chamber.

The present invention is directed to a process for drying a material web in an apparatus that includes a roll having an outer jacket with a plurality of throughput openings, a device for supplying gas through the outer jacket, and an inner jacket, located within the outer jacket, arranged to form a ring chamber with the outer jacket, in which the inner jacket is gas tight to seal the ring chamber in a gas-tight manner from an interior of the inner jacket. The process includes guiding the material web to at least partially wrap the roll, blowing air through the outer jacket and one of into and out of the ring chamber in a region in which the material web wraps the roll, and blowing air through the material web in the wrap region of the roll.

According to a feature of the invention, the apparatus can further include a blowing device arranged outside of said outer jacket in the wrap region of roll, and the process may further include blowing gas into the ring chamber. The apparatus can further include a suction device coupled to the ring chamber, and the process may further include suctioning the ring chamber. The blowing device may include at least one blowing hood, and the process can further include impinging the material web with hot air, and suctioning the hot air passing through the material web and into the ring chamber. The ring chamber can be suctioned at a face end of the ring chamber.

In accordance with yet another feature of the present invention, the apparatus can further include a blowing device, and the process may further include blowing gas outwardly from the ring chamber. The apparatus can further include a suction device arranged in a region in which the material web wraps the outer jacket, and the process may further include suctioning the air exiting the ring chamber. The gas blown out from the ring chamber may be supplied at a face end of the ring chamber.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
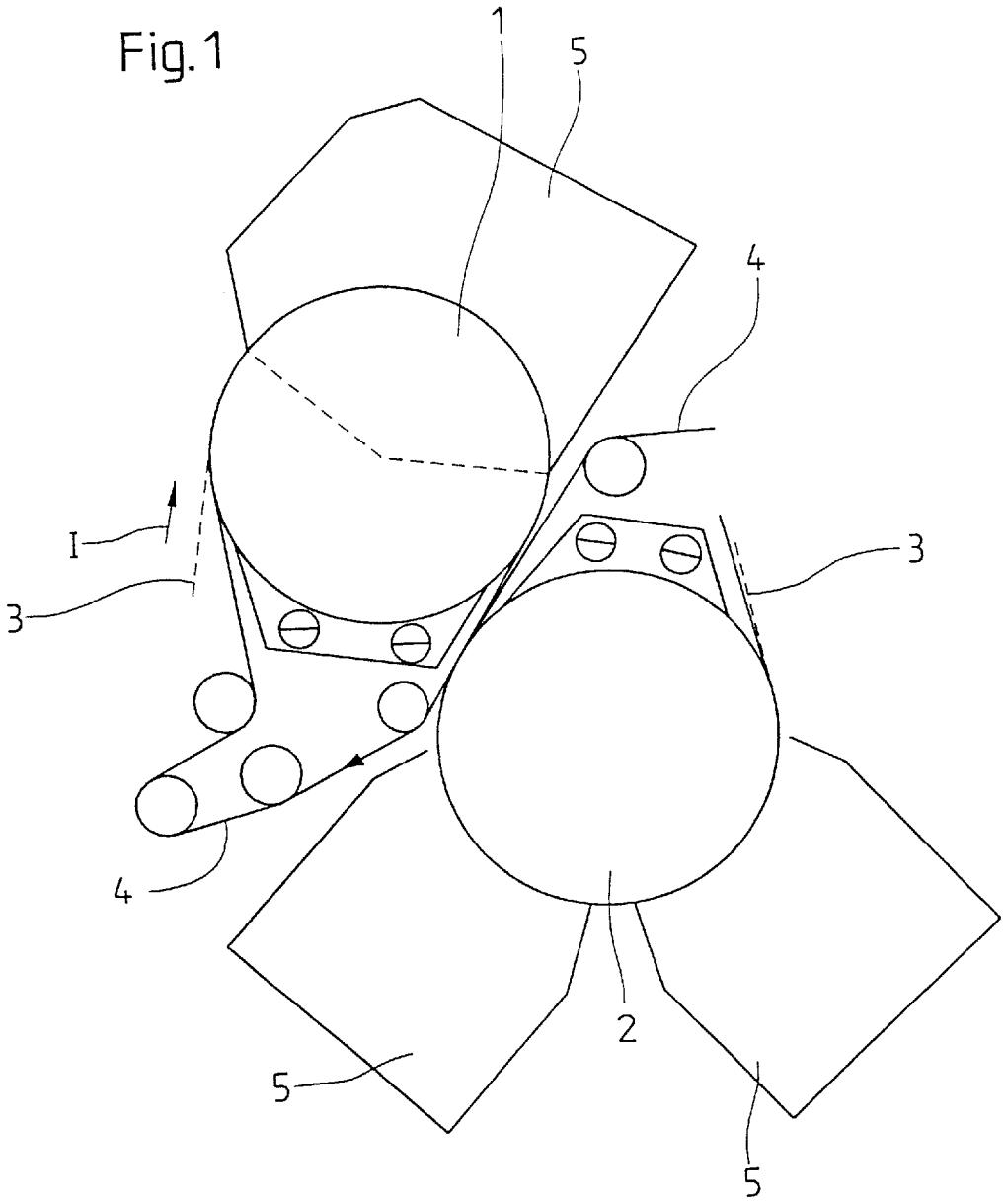
FIG. 1 illustrates a section of a drying section with rolls in accordance with the features of the instant invention.

A section of a drying section shown in FIG. 1 includes a first roll 1 and a second roll 2, over which a material web 3 is guided in a meandering manner in the direction of the arrow I. Each of rolls 1 and 2 is embodied or formed as a suction roll and connected to a suction device, which is not shown in detail here. Furthermore, each of rolls 1 and 2 is surrounded by a wire 4, which is positioned between material web 3 and rolls 1 and 2. Wire 4 can, in a manner other than is shown, be fixed on the rolls, e.g., wound or shrunk onto the rolls.

Blowing hoods 5 are arranged in the respective region of wrapping of the two rolls 1 and 2 with material web 3, such that material web 3 can be impinged with air for the purpose of jet impingement drying. In the case of the roll 1, the hood 5 is constructed in one piece and in the case of the roll 2, it is constructed in two pieces.

Figure 2:
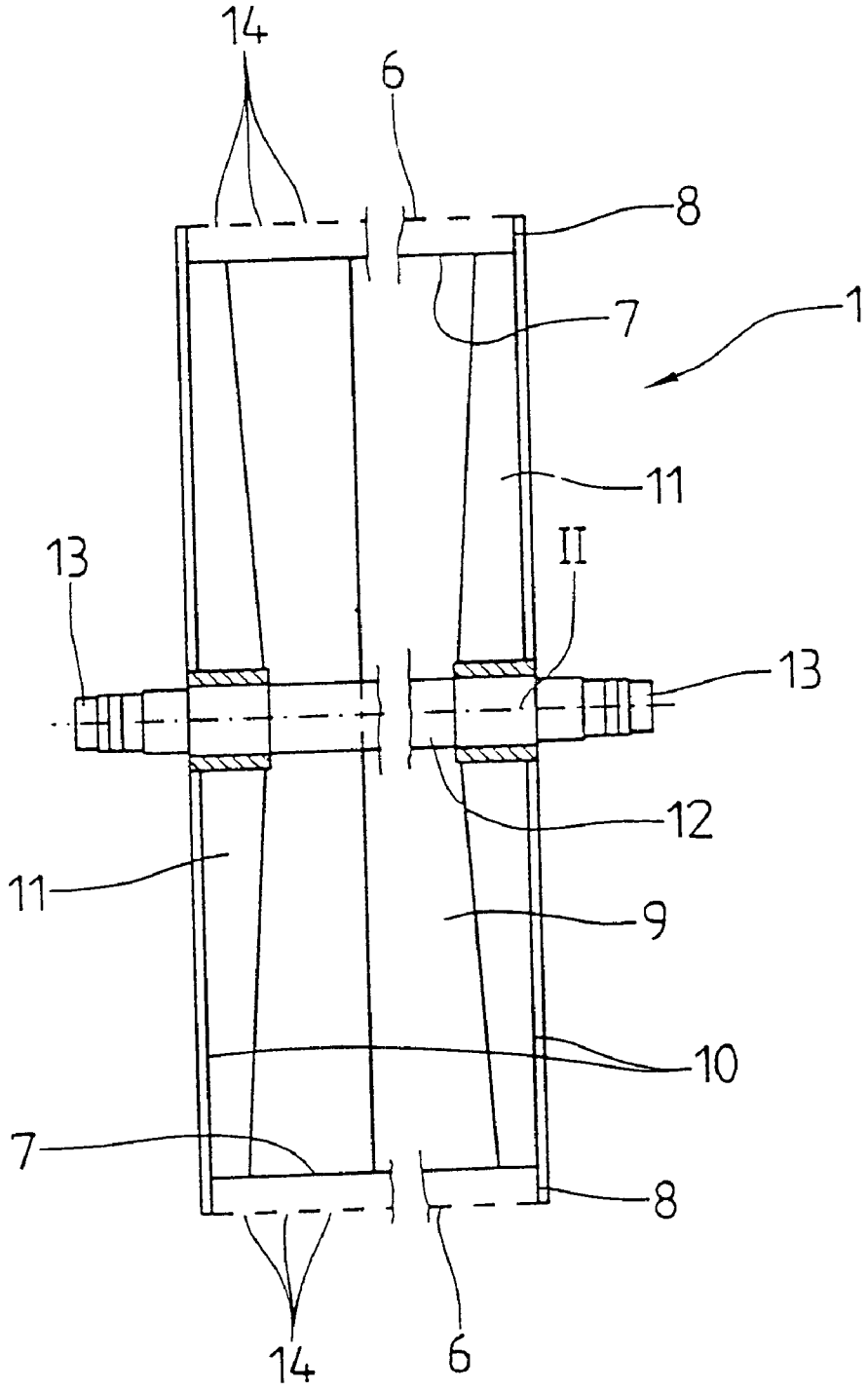
FIG. 2 illustrates a longitudinal section of a roll in accordance with the features of the instant invention.
Figure 3:
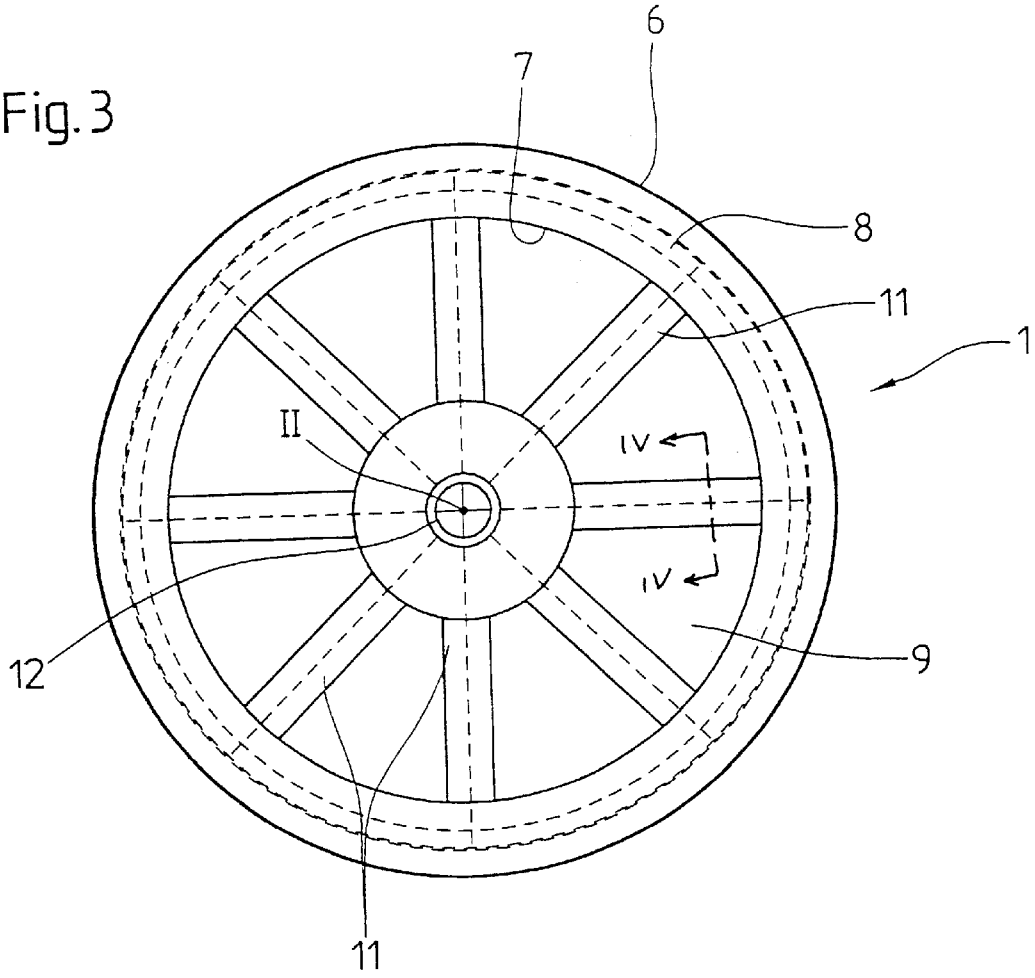
FIG. 3 illustrates a cross section of the roll depicted in FIG. 2.

As can be seen from FIGS. 2 and 3, roll 1 according to the invention includes a roll jacket 6 for guiding the material web 3 and an inner jacket 7 arranged in an interior of roll jacket 6. Between outer roll jacket 6 and inner jacket 7, a ring-shaped intermediate chamber 8 is formed that is sealed off in a gas-tight manner from interior 9 of inner jacket 7. For this purpose, inner jacket 7 is constructed in a gas-tight manner and provided with overlays 10 on its face ends.

In contrast, outer roll jacket 6 has gas throughput openings, e.g., in the form of bores 14. In this manner, intermediate chamber 8 can be connected to the outside space.

Figure 4:
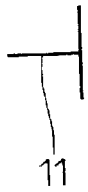
FIG. 4 illustrates a section according to the line IV—IV depicted in FIG. 3.

Inner jacket 7 is supported by way of spoke-like support elements 11 on a carrier 12 extending along a longitudinal axis II of roll 1, around which roll 1 is rotatable. FIG. 4 shows a cross-section of spoke-like support elements 11. Outer roll jacket 6 is carried by inner jacket 7.

In particular, the size of intermediate chamber 8 is selected to correspond to a desired flow rate of the gas, e.g., such that the volume of intermediate chamber 8 is approximately 10 to approximately 15% of the volume of the entire interior of roll 1. Intermediate chamber 8 is connected to a suction device, e.g., a suction box, that can be provided on the face end aligned with intermediate chamber 8 (not shown).

In principle, however, intermediate chamber 8 can also be connected to a blowing device, which can be constructed or formed in a corresponding manner, e.g., if roll 1 is used for the flow-through drying of material web 3. In the case of such a use, a blowing or suction zone can be placed in the wrapping zone of roll 1 instead of, or in addition to, a suction or blowing device connected to intermediate chamber 8. In this manner as well, it is possible to produce a flow-through of material web 3 in the desired direction for the purpose of drying it.

As shown in FIGS. 2 and 3, the size of bearing pins 13 of central carrier 12 and the size of the bearing supports of roll 1 (not shown here) can be kept relatively small because of the lateral arrangement of the suction or blowing device connected to intermediate chamber 8. Overall, a more simple construction of roll 1 results.

The blowing and suction devices as well as the blowing and suction boxes are respectively sealed against waste flows by seals. Moreover, fixed covers for throughput openings 14 in outer roll jacket 6 can be provided in the regions of rolls 1 and 2 that are not wrapped.

This results in a roll with short reaction times during the build-up of desired overpressure or underpressure, which is particularly advantageous during the threading process after an interruption in production caused by a tear in the material web or the like. The chamber of the roll that is suctioned or loaded with pressure can be laid out for an optimal flow rate of the gas. By reducing the largest part of the roll to a carrying function, the roll can also be constructed in a simpler and lighter fashion. The total mass of the roll can thus be reduced.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE NUMERALS

1 Roll
2 Roll
3 Material web
4 Wire
5 Blowing hood
6 Roll jacket
7 Inner jacket
8 Intermediate chamber
9 Inner chamber
10 Lateral overlays
11 Support element
12 Central carrier
13 Bearing pin
14 Throughput opening
I Web travel direction
II Roll longitudinal axis

What is claimed:

1. A roll for a drying section of a machine for producing a material web, comprising:

a jacket having a plurality of throughput openings;

a device for supplying gas through said jacket;

a second jacket located within said jacket being arranged to form a ring chamber with said jacket; and said second jacket being gas tight to seal said ring chamber in a gas-tight manner from an interior of said second jacket.

2. The roll in accordance with claim 1, wherein, during operation, the material web at least partially wraps said jacket.

3. The roll in accordance with claim 1, wherein said roll is structured and arranged for guiding and holding the paper web while being impinged by a drying gas.

4. The roll in accordance with claim 1, wherein the material web is guided over at least a portion of said jacket and a gas is supplied by said gas supply device from outside through the material web into said ring chamber.

5. The roll in accordance with claim 1, wherein a gas is supplied from outside of said jacket into said ring chamber.

6. The roll in accordance with claim 1, wherein a-suction device is coupled to said ring chamber.

7. The roll in accordance with claim 6, wherein said suction device is coupled to said ring chamber on a face end.

8. The roll in accordance with claim 7, wherein said suction device comprises a suction box aligned with said ring chamber.

9. The roll in accordance with claim 1, wherein the material web is guided to at least partially wrap around said jacket and a blowing zone is arranged in a region in which the material web wraps said jacket.

10. The roll in accordance with claim 9, wherein said blowing zone is formed by a blow box.

11. The roll in accordance with claim 10, wherein said blow box is sealed against waste flows with lateral seals.

12. The roll in accordance with claim 11, wherein said lateral seal comprises at least one of sealing brushes and doctors.

13. The roll in accordance with claim 1, wherein the material web is guided over at least a portion of said jacket and a gas is supplied by said gas supply device outwardly from said ring chamber through the material web.

14. The roll in accordance with claim 1, wherein a gas is supplied outwardly from said ring chamber.

15. The roll in accordance with claim 1, wherein a blowing device is coupled to said ring chamber.

16. The roll in accordance with claim 1, wherein a blowing device is coupled to an end face of said ring chamber.

17. The roll in accordance with claim 16, wherein said blowing device comprises a blow box aligned with said ring chamber.

18. The roll in accordance with claim 1, wherein the material web is guided to at least partially wrap said jacket, a gas is supplied outwardly from said ring chamber through the material web, and a suction zone is arranged in a region in which the material web wraps said jacket.

19. The roll in accordance with claim 18, wherein said suction zone is formed by a suction box.

20. The roll in accordance with claim 19, wherein said suction box is sealed against waste flows with lateral seals.

21. The roll in accordance with claim 20, wherein said lateral seal comprise at least one of sealing brushes and doctors.

22. The roll in accordance with claim 1, further comprising fixed coverings for said throughput openings located in said inner chamber.

23. The roll in accordance with claim 22, wherein the material web is guided to at least partially wrap said jacket, and said fixed coverings are arranged in a region of said jacket which is not wrapped by the material web.

24. The roll in accordance with claim 1, further comprising a central carrier arranged to extend along a longitudinal axis of said roll, wherein said roll jacket and said second jacket are rotatably supported on said central carrier.

25. The roll in accordance with claim 24, further comprising spoke-like support elements arranged in an interior of said second jacket, wherein said spoke-like support elements are structured and arranged to support said second jacket on said central carrier.

26. The roll in accordance with claim 1, wherein said jacket is carried by said second jacket.

27. The roll in accordance with claim 1, wherein a size of said ring chamber corresponds to a desired gas flow speed.

28. The roll in accordance with claim 1, wherein said ring chamber size is between approximately 10 to approximately 15% of a volume of an entire interior of said jacket.

29. A dryer section in a machine for producing a material web, comprising:

a roll comprising an outer jacket with a plurality of throughput openings structured and arranged for gas flow and an inner jacket located within said jacket being arranged to form a ring chamber with said outer jacket, in which said inner jacket is gas tight to seal said ring chamber in a gas-tight manner from an interior of said inner jacket; and a wire arranged to at least partially wrap said outer jacket, said wire being structured and arranged to guide the material to at least partially wrap said outer jacket.

30. The dryer section in accordance with claim 29, further comprising a blowing device arranged outside of said outer jacket in a region in which the material web wraps said outer jacket, wherein gas is supplied through the material web and into said ring chamber.

31. The dryer section in accordance with claim 30, wherein a suction device is coupled to said ring chamber.

32. The dryer section in accordance with claim 31, wherein said blowing device comprises at least one blowing hood arranged to impinge the material web with hot air.

33. The dryer section in accordance with claim 31, wherein said suction device is coupled to a face end of said ring chamber.

34. The dryer section in accordance with claim 29, further comprising a blowing device arranged to blow gas outwardly from said ring chamber and through the material web.

35. The dryer section in accordance with claim 34, wherein a suction device is arranged in a region in which the material web wraps said outer jacket.

36. The dryer section in accordance with claim 35, wherein said blowing device is coupled to said ring chamber.

37. The dryer section in accordance with claim 36, wherein said blowing device is coupled to a face end of said ring chamber.

38. A process for drying a material web in an apparatus that includes a roll having an outer jacket with a plurality of throughput openings, a device for supplying gas through the outer jacket, and an inner jacket, located within the outer jacket, arranged to form a ring chamber with the outer jacket, in which the inner jacket is gas tight to seal the ring chamber in a gas-tight manner from an interior of the inner jacket, the process comprising:

guiding the material web to at least partially wrap the roll;

blowing air through the outer jacket and one of into and out of the ring chamber in a region in which the material web wraps the roll; and blowing air through the material web in the wrap region of the roll.

39. The process in accordance with claim 38, wherein the apparatus further includes a blowing device arranged outside of said outer jacket in the wrap region of roll, and the process further comprises:

blowing gas into the ring chamber.

40. The process in accordance with claim 39, wherein the apparatus further includes a suction device coupled to the ring chamber, and the process further comprises:

suctioning the ring chamber.

41. The process in accordance with claim 40, wherein the blowing device includes at least one blowing hood, and the process further includes:

impinging the material web with hot air; and suctioning the hot air passing through the material web and into the ring chamber.

42. The process in accordance with claim 40, wherein the ring chamber is suctioned at a face end of the ring chamber.

43. The process in accordance with claim 38, wherein the apparatus further includes a blowing device, and the process further comprises:

blowing gas outwardly from the ring chamber.

44. The process in accordance with claim 43, wherein the apparatus further includes a suction device arranged in a region in which the material web wraps the outer jacket, and the process further comprises:

suctioning the air exiting the ring chamber.

45. The process in accordance with claim 44, wherein the gas blown out from the ring chamber is supplied at a face end of the ring chamber.

* * * * *